US011575194B2

(12) United States Patent
Huang

(10) Patent No.: US 11,575,194 B2
(45) Date of Patent: Feb. 7, 2023

(54) ANTENNA STRUCTURE AND ANTENNA ARRAY

(71) Applicant: AchernarTek Inc., San Diego, CA (US)

(72) Inventor: Wei Huang, San Diego, CA (US)

(73) Assignee: ACHERNARTEK INC., San Diego, CA (US)

( * ) Notice: Subject to any disclaimer, the term of this patent is extended or adjusted under 35 U.S.C. 154(b) by 42 days.

(21) Appl. No.: 17/464,992

(22) Filed: Sep. 2, 2021

(65) Prior Publication Data

US 2022/0328953 A1 Oct. 13, 2022

Related U.S. Application Data

(60) Provisional application No. 63/173,541, filed on Apr. 12, 2021.

(51) Int. Cl.

| | |
|---|---|
| ***H01Q 1/36*** | (2006.01) |
| ***H01Q 9/04*** | (2006.01) |
| ***H01Q 1/22*** | (2006.01) |
| ***H01Q 21/06*** | (2006.01) |

(52) U.S. Cl.
CPC ..... *H01Q 1/2283* (2013.01); *H01Q 1/36* (2013.01); *H01Q 9/0407* (2013.01); *H01Q 21/065* (2013.01)

(58) Field of Classification Search
CPC ..... H01Q 1/2283; H01Q 1/36; H01Q 1/38; H01Q 9/04; H01Q 9/0407; H01Q 9/0414; H01Q 21/065; H01Q 13/00; H01Q 13/10
See application file for complete search history.

(56) References Cited

U.S. PATENT DOCUMENTS

| | | | | |
|---|---|---|---|---|
| 7,636,063 | B2 * | 12/2009 | Channabasappa ... | H01Q 9/0442 343/700 MS |
| 7,973,734 | B2 * | 7/2011 | Strempel ..... | H01Q 1/30 343/873 |
| 2010/0090903 | A1 * | 4/2010 | Byun ..... | H01Q 9/0414 343/700 MS |

* cited by examiner

*Primary Examiner* — Thai Pham
(74) *Attorney, Agent, or Firm* — McClure, Qualey & Rodack, LLP

(57) ABSTRACT

An antenna structure has a stack of dielectric layers and metal layers. The antenna structure includes a radiator and a grounding structure. The radiator has a parasitic radiator element, a main radiator element and a ground plane element respectively in a first metal layer, a second metal layer and a third metal layer of the metal layers. The parasitic radiator element and the main radiator element are physically spaced by a first dielectric layer of the dielectric layers. The main radiator element and the ground plane element are physically spaced by a second dielectric layer of the dielectric layers. The grounding structure laterally surrounds between the main radiator element and the ground plane element for blocking electromagnetic radiation, but not between the parasitic radiator element and the main radiator element.

20 Claims, 11 Drawing Sheets

ANTENNA STRUCTURE AND ANTENNA ARRAY

RELATED APPLICATIONS

This application claims priority to U.S. Provisional Application Ser. No. 63/173,541, filed Apr. 12, 2021, which is herein incorporated by reference.

BACKGROUND

Field of the Invention

The disclosure relates to an antenna field, and more particularly to an antenna structure and an antenna array.

Description of Related Art

5G New Radio (NR) is a recently developed radio access technology that supports high throughput, low latency and large capacity communications. In comparison with previous 4G radio communication systems, a 5G NR device uses a millimeter wave (mmWave) carrier signal to up-convert baseband data into a radio frequency (RF) signal for radio transmissions. On the other hand, in response to market orientation, most communication products, such as smartphones, 5G femtocells, etc., have recently moved toward compact and low cost specifications. Thus, how to design an antenna with low manufacture cost as well as great performance for mmWave communication systems (e.g. 5G and/or beyond 5G) has become one of the goals of those skilled in the related art.

SUMMARY

One aspect of the disclosure directs to an antenna structure which has a stack of dielectric layers and metal layers. The antenna structure includes a radiator and a grounding structure. The radiator has a parasitic radiator element, a main radiator element and a ground plane element respectively in a first metal layer, a second metal layer and a third mental layer of the metal layers. The parasitic radiator element and the main radiator element are physically spaced by a first dielectric layer of the dielectric layers. The main radiator element and the ground plane element are physically spaced by a second dielectric layer of the dielectric layers. The grounding structure laterally surrounds between the main radiator element and the ground plane element.

In accordance with one or more implementations of the disclosure, the grounding structure includes plural grounding vias each vertically extending from the second metal layer to the third mental layer.

In accordance with one or more implementations of the disclosure, the grounding vias are buried vias, blind vias, or a combination thereof.

In accordance with one or more implementations of the disclosure, the grounding structure has a frame shape in the planar view of the antenna structure.

In accordance with one or more implementations of the disclosure, the main radiator element and the parasitic radiator element are patches arranged in parallel in the normal direction of the antenna structure.

In accordance with one or more implementations of the disclosure, the metal layers are alternately stacked with the dielectric layers.

In accordance with one or more implementations of the disclosure, the antenna structure further includes a first slot, a second slot, a first feeding trace and a second feeding trace. The first slot and the second slot are defined by the third metal layer. The first feeding trace is laterally overlapped with the first slot, and is configured to electromagnetically couple energy to the main radiator element through the first slot. The second feeding trace is laterally overlapped with the second slot, and is configured to electromagnetically couple energy to the main radiator element through the second slot.

In accordance with one or more implementations of the disclosure, the longitudinal directions of the first slot and the second slot are perpendicular.

In accordance with one or more implementations of the disclosure, the first feeding trace and the second feeding trace are in the same one of the metal layers.

In accordance with one or more implementations of the disclosure, the antenna structure further includes a first probe and a second probe that are vertically below the main radiator element and configured to electromagnetically couple energy to the main radiator element to enable dual-polarized radiation of the radiator.

In accordance with one or more implementations of the disclosure, the first probe and the second probe are vertically covered by the main radiator element in the normal direction of the antenna structure.

In accordance with one or more implementations of the disclosure, the antenna structure further includes a first via and a second via that are directly contacting the main radiator element and configured to feed energy to the main radiator element enable dual-polarized radiation of the radiator.

In accordance with one or more implementations of the disclosure, the first via and the second via are covered by the main radiator element.

In accordance with one or more implementations of the disclosure, the first via and the second via are blind vias.

Another aspect of the disclosure is directed to an antenna array which includes plural antenna cells arranged in an array. Each antenna cell has a stack of dielectric layers and metal layers. Each antenna cell includes a radiator and a grounding structure. For each antenna cell, the radiator has a parasitic radiator element, a main radiator element, and a ground plane element respectively in a first metal layer, a second metal layer and a third metal layer of the metal layers, and the parasitic radiator element and the main radiator element are physically spaced by a first dielectric layer of the dielectric layers, the main radiator element and the ground plane element are physically spaced by a second dielectric layer of the dielectric layers, and the grounding structure laterally surrounds between the main radiator element and the ground plane element for blocking electromagnetic radiation, but not between the parasitic radiator element and the main radiator element.

In accordance with one or more implementations of the disclosure, the dielectric layers and the metal layers of the antenna cells are mapped in a one-to-one manner.

In accordance with one or more implementations of the disclosure, the antenna cells are physically separated.

BRIEF DESCRIPTION OF THE DRAWINGS

The foregoing aspects and many of the accompanying advantages of this disclosure will become more readily appreciated as the same becomes better understood by reference to the following detailed description, when taken in conjunction with the accompanying drawings.

DETAILED DESCRIPTION

Figure 1A:
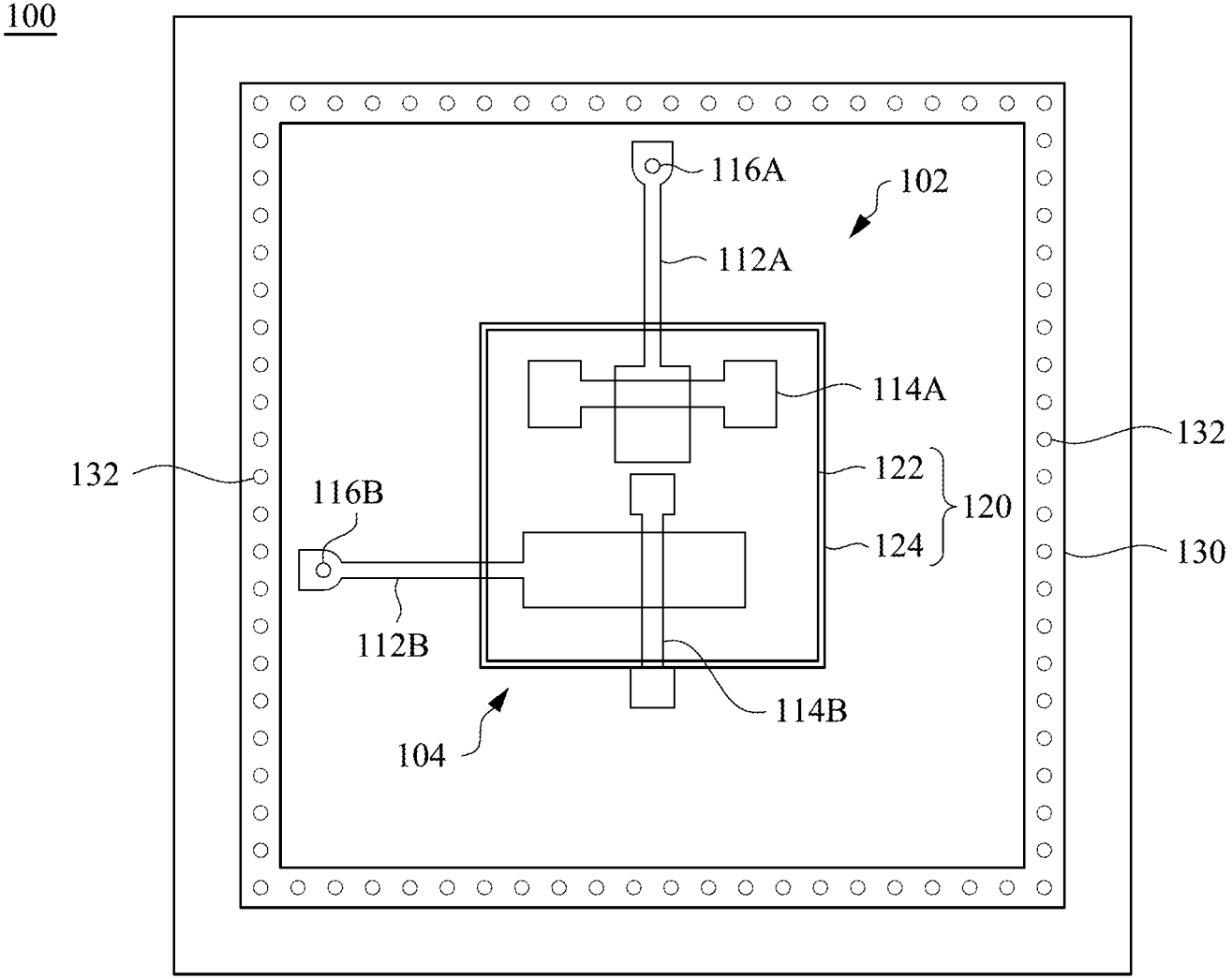
FIG. 1A is a top view of an antenna structure in accordance with some implementations of the disclosure.

The detailed explanation of the disclosure is described as following. The described preferred embodiments are presented for purposes of illustrations and description, and they are not intended to limit the scope of the disclosure.

Terms used herein are only used to describe the specific embodiments, which are not used to limit the claims appended herewith. Unless limited otherwise, the term "a," "an," "one" or "the" of the single form may also represent the plural form.

The spatially relative terms are intended to encompass different orientations of the device in use or operation in addition to the orientation depicted in the figures. The device may be otherwise oriented (rotated 90 degrees or at other orientations) and the spatially relative descriptors used herein may likewise be interpreted accordingly.

In the following description and claims, the term "connect" along with their derivatives, may be used. In particular embodiments, "connect" may be used to indicate that two or more elements are in direct physical or electrical contact with each other, or may also mean that two or more elements may not be in direct contact with each other. "Connect" may still be used to indicate that two or more elements cooperate or interact with each other.

It will be understood that, although the terms "first," "second," "third" . . . etc., may be used herein to describe various elements and/or components, these elements and/or components, should not be limited by these terms. These terms are only used to distinguish elements and/or components.

The document may repeat reference numerals and/or letters in the various examples. This repetition is for the purpose of simplicity and clarity and does not in itself dictate a relationship between the various embodiments and/or configurations discussed. In addition, within the descriptions of the figures, similar elements are provided similar names and reference numerals as those of the previous figure(s). Where a later figure utilizes the element in a different context or with different functionality, the element is provided a different leading numeral representative of the figure number (e.g, 1xx for FIGS. 1 and 2xx for FIG. 2). The specific numerals assigned to the elements are provided solely to aid in the description and not meant to imply any structural or functional limitations.

FIG. 1A is a top view of an antenna structure 100 in accordance with some implementations of the disclosure. The antenna structure 100 includes two antenna feeds 102 and 104 which may also be referred to as a dual-polarized antenna feed. The polarized directions of the antenna feeds 102 and 104 may be perpendicular. In some implementations, the antenna feeds 102 and 104 are respective a horizontally polarized antenna feed and a vertically polarized antenna feed. In some other implementations, the antenna feeds 102 and 104 are respective a vertically polarized antenna feed and a horizontally polarized antenna feed. It is noted that the antenna structure in the context is not limited to the dual-polarized antenna of FIG. 1A. For example, in some examples, the antenna structure 100 may be modified to be a single-polarized antenna (e.g. with only one of the antenna feeds 102 and 104).

The antenna feeds 102 and 104 are a slot antenna. The antenna feed 102 includes a feeding trace 112A, a slot 114A and a radiator 120 that is formed of a main radiator element 122 and a parasitic radiator element 124. In some implementations, as shown in FIG. 1A, the main radiator element 122 and parasitic radiator element 124 are rectangular patches. Other shapes and/or types of the main radiator element 122 and parasitic radiator element 124 may be adopted in other implementations. The antenna feed 104 includes a feeding trace 112B and a slot 114B as well as the radiator 120. In other words, the antenna feeds 102 and 104 share the same radiator 120. The feeding traces 112A and 112B are laterally staggered, and the longitudinal directions of the feeding traces 112A and 112B are perpendicular. The slots 114A and 114B are apertures of a ground plane element at different positions of the antenna structure 100. The feeding trace 112A, the slot 114A and the main radiator element 122 are overlapped, such that the feeding trace 112A may be configured to electromagnetically couple energy to the main radiator element 122 through the slot 114A. Similarly, the feeding trace 112B, the slot 114B and the main radiator element 122 are overlapped, such that the feeding trace 112B may be configured to electromagnetically couple energy to the main radiator element 122 through the slot 114B.

The antenna structure 100 may be a multilayer antenna structure with plural dielectric layers and metal layers. In the antenna structure 100, the feeding trace 112A/112B, the slot 114A/114B, the main radiator element 122 and the parasitic radiator element 124 are in different metal layers. One terminal of the feeding trace 112A is connected to a via 116A for electrically coupling another electrical component in the same antenna structure 100, such as an active electrical component (e.g. a switch), a passive electrical component (e.g. an inductor), a combination thereof, and/or an electrical device bonded to the antenna structure 100, such as a radio frequency integrated chip (RFIC) or a printed circuit board (PCB). Similarly, one terminal of the feeding trace 112B is connected to a via 116B for electrically coupling another electrical component in the same antenna structure 100 or an electrical device bonded to the antenna structure 100. Other electrical components may be utilized to electrically couple to the feeding trace 112A/112B through the vias 116A/116B. Each of the vias 116A and 116B may be a blind via, a buried via, a stacked via, a staggered via, a combination thereof, or any type of via applicable to the antenna structure 100, and may be formed by laser drilling, electroplating, electroless plating, or another suitable technique.

The antenna structure 100 also includes a grounding structure 130 for isolating the radiator 120. The grounding structure 130 connects to the ground plane element and laterally surrounds the main radiator element 122. In particular, in some implementations, the grounding structure 130 is a via wall structure including plural grounding vias 132. Each of the grounding vias 132 may be a blind via, a buried via, a stacked via, a staggered via, a combination thereof, or any type of via applicable to the antenna structure 100, and may be formed by laser drilling, electroplating, electroless plating, or another suitable technique. The grounding structure 130 may have a frame shape in the planar view of the antenna structure 100, such as a rectangular frame shape or any other frame shape.

It is noted that the antenna structure 100 is merely an illustrative example and the disclosure is not restricted thereto. For example, the positions, the layout patterns, the lengths and the widths of the feeding traces 112A and 112B and/or the slots 114A and 114B, the lengths of the feeding traces 112A and 112B, the slots 114A and 114B and/or the grounding structure 130 may be modified for various applications. Furthermore, in some implementations, the ground plane element may be modified for the feeding traces 112A and 112B to feed energy to the radiator 120 without penetrating slots for electromagnetic waves radiation. In some other implementations, the ground plane element and the feeding traces 112A and 112B may be modified to another feeding source for feeding energy to the radiator to radiate electromagnetic waves.

Figure 1B:
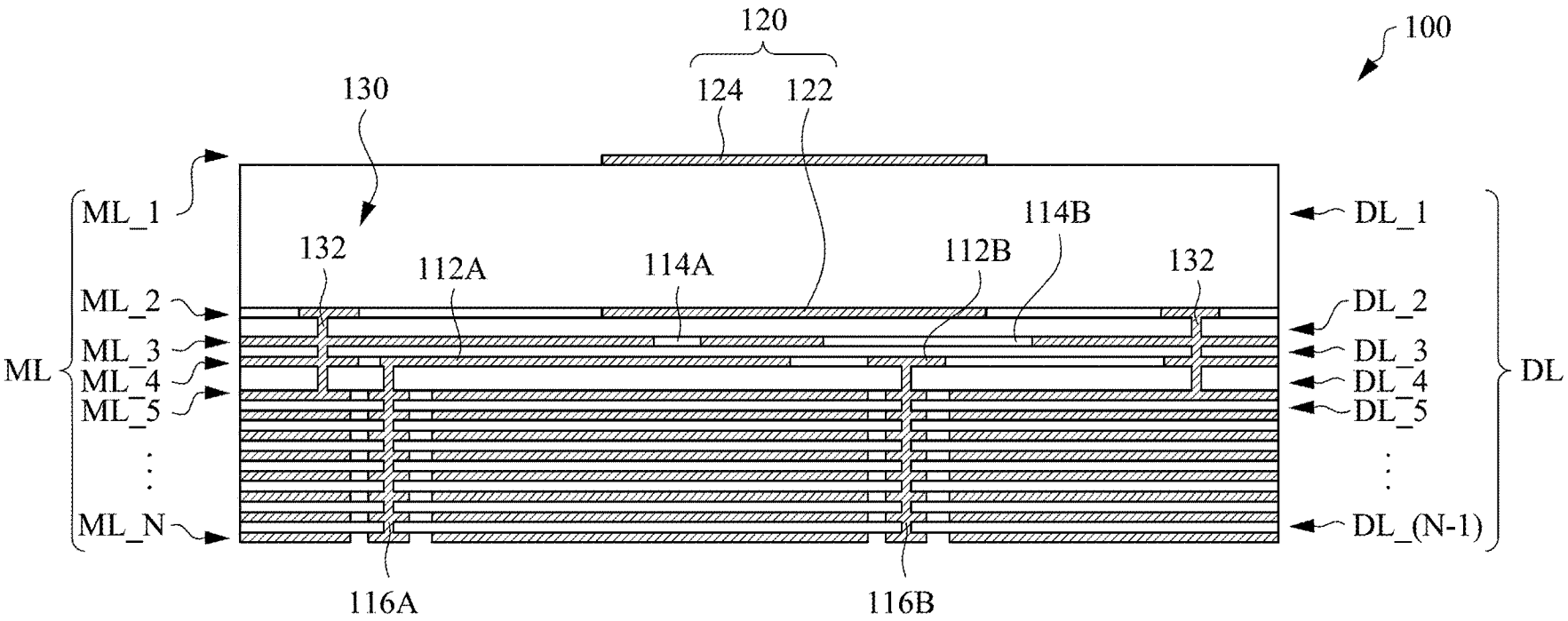
FIG. 1B is a partial schematic cross-sectional view of the antenna structure shown in FIG. 1A.

FIG. 1B is a partial schematic cross-sectional view of the antenna structure 100 shown in FIG. 1A. The antenna structure 100 is a monolithic board structure with a stack of metal layers ML and dielectric layers DL. The metal layers ML may be formed form copper, aluminum, nickel and/or another metal, a mixture or a metal alloy thereof, an electrically conductive metallic compound, and/or another suitable material. The dielectric layers DL may be formed from FR4 material, glass, ceramic, epoxy resin, silicon, and/or another suitable material. Based on the material type of the dielectric layers DL, the antenna structure 100 may be formed by various processes, such as low-temperature cofired ceramic (LTCC), integrated passive device (IPD), multi-layered film, multi-layered PCB or another multi-layered process.

In some implementations, as shown in FIG. 1B, the metal layers ML are alternately stacked with the dielectric layers DL in the normal direction of the antenna structure 100. Another stacked structure with the metal layers ML and the dielectric layers DL may be made according to the structure shown in FIG. 1B. For example, two or more of the dielectric layers DL may be interposed between adjacent two of the metal layers ML.

In FIG. 1B, the metal layers ML are also respectively labeled as ML_1-ML_N from upper to lower, where N is the number of metal layers, and the dielectric layers DL are also respectively labeled as DL_1-DL_(N−1) from upper to lower. The metal layers ML ML_1-ML_N may be formed of the same material (e.g. copper) or different materials. The dielectric layer DL_i is interposed between the metal layers ML_i and ML_(i+1), where i is an integer from 1 to (N−1). Each metal layer ML may include one or more radiator elements, one or more conductive traces, one or more active electrical components (e.g. a switch), one or more passive electrical components (e.g. an inductor), and/or another component for forming an antenna feed. The metal layers ML and the dielectric layers DL may include different patterns based on design requirements of the antenna structure.

As shown in FIG. 1B, the feeding traces 112A and 112B are in the metal layer ML_4, the slots 114A and 114B are in the metal layer ML_3, and the main radiator element 122 and the parasitic radiator element 124 are respectively in the metal layers ML_2 and ML_1. The main radiator element 122 and the parasitic radiator element 124 are physically spaced by the dielectric layer DL_1. The metal layers ML_3 is also referred to as a ground plane element of the antenna structure 100, and the slots 114A and 114B are defined by such ground plane element. In some implementations, the longitudinal directions of the slots 114A and 114B are perpendicular. One terminal of the feeding trace 112A connects to a via 116A extending from the metal layer ML_3 to the lowermost metal layer ML_N for electrically coupling to another electrical component, such as an RFIC, a PCB and/or the like. Similarly, one terminal of the feeding trace 112B connects to a via 116B extending from the metal layer ML_4 to the lowermost metal layer ML_N for electrical connection with another electrical component, such as an RFIC, a PCB and/or the like. The feeding traces 112A and 112B may be in different metal layers in another implementation.

The grounding structure 130 is covered by the uppermost dielectric layer DL_1. In other words, as shown in FIG. 1B, the grounding structure 130 and the parasitic radiator element 124 are respectively at to opposite sided of the uppermost dielectric layer DL_1. The main radiator element 122 and the parasitic radiator element 124 may be patches which are arranged in parallel with each other in a normal direction of the antenna structure 100 for eliminating surface waves in the antenna structure 100. As shown in FIGS. 1A-1B, the grounding structure 130 includes longitudinally overlapped strip frames respectively in the metal layers ML_2-ML_5. The top surface of the grounding structure 130 is coplanar with the top surface of the main radiator element 122 because the uppermost strip frame of the grounding structure 130 and the main radiator element 122 are both in the metal layer ML_2. The grounding vias 132 of the grounding structure 130 may be blind vias which vertically extend from the metal layer ML_2 to the metal layer ML_5. In particular, the structure of the metal layers ML_2-ML_5 and the dielectric layers DL_2-DL_4 is a substrate integrated waveguide (SIW) cavity backed antenna structure, in which the grounding structure 130 forms a partial-cavity backed aperture. The cavity between the main radiator element 122 and the elements in the underlying layers (e.g. the slots 114A and 114B, the feeding traces 112A and 112B, and the other elements in the metal layers ML_3-ML_5) suspends surfaces wave propagations between the dielectric layers DL and the metal layers ML. The antenna structure 100 has a half-cavity backed aperture instead of a full-cavity backed aperture. In particular, for the half-cavity backed aperture of the antenna structure 100, no via structure is arranged in or penetrating the uppermost dielectric layer DL_1 to be removed by utilizing a removing technique (e.g. back drilling), and thus the electrical routing designs in the antenna structure is not affected. In other implementations, each of the grounding vias 132 extends from the metal layer ML_2 to the metal layer ML_N for suspending surfaces wave propagations between the dielectric layers DL and the metal layers ML.

The antenna structure 100 may be formed by directly bonding the stacked structure of the metal layer ML_1 and the dielectric layer DL_1 to the stacked structure of the metal layers ML_2-ML_N and the dielectric layers DL_2-DL_(N−1). By utilizing the bonding technique, the antenna structure 100 can achieve the abovementioned half-cavity backed aperture without having to perform a back drilling process to remove a portion of each via between the first metal layer ML_1 and the second metal layer ML_2.

The antenna structure 100 may be modified for various polarizations. For example, in some implementations, the antenna structure 100 may be modified to be a single-polarized antenna structure, e.g., the antenna structure 100 includes only one of the antenna feeds 102 and 104.

Figure 2A:
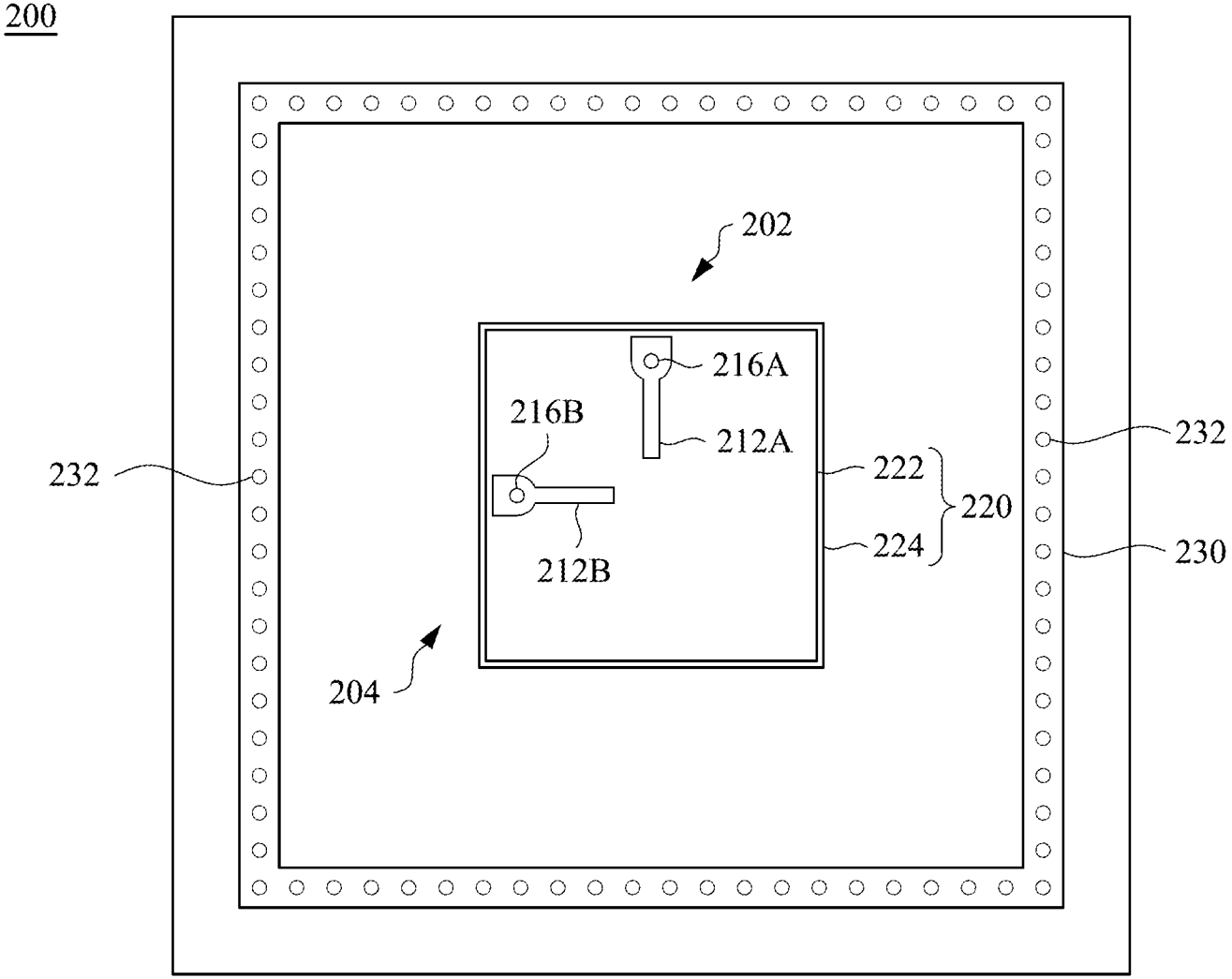
FIG. 2A is a top view of an antenna structure in accordance with some other implementations of the disclosure.
Figure 2B:
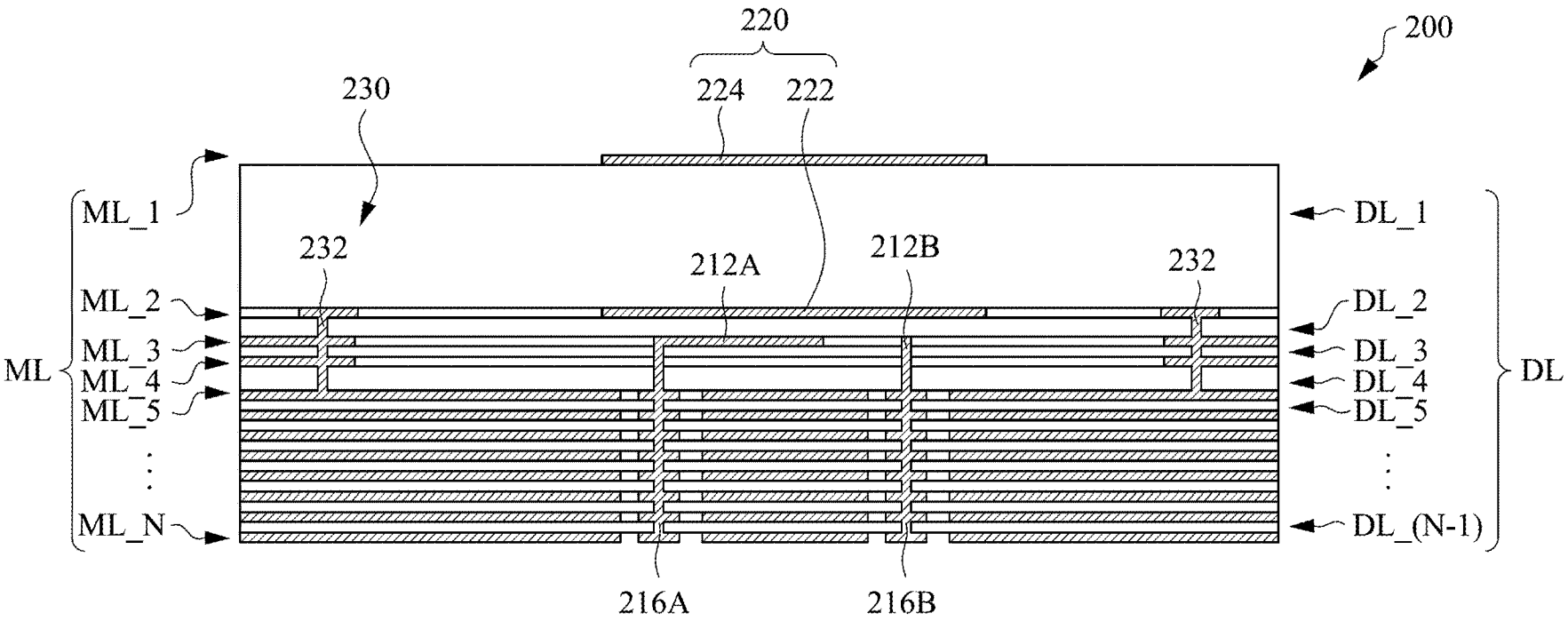
FIG. 2B is a partial schematic cross-sectional view of the antenna structure shown in FIG. 2A.

FIG. 2A is a top view of an antenna structure 200 in accordance with some other implementations of the disclosure, and FIG. 2B is a partial schematic cross-sectional view of the antenna structure 200 shown in FIG. 2A. The antenna structure 200 is a monolithic board structure with a stack of metal layers ML and dielectric layers DL. In the antenna structure 200, the metal layers ML are also respectively labeled as ML_1-ML_N from upper to lower, where N is the number of metal layers, and the dielectric layers DL are also respectively labeled as DL_1-DL_(N−1) from upper to lower. The antenna structure 200 includes two antenna feeds 202 and 204 which may also be referred to as a dual-polarized antenna feed, and the polarized directions of the antenna feeds 202 and 204 may be perpendicular.

The antenna feed 202 includes a bent feeding probe 212A and a radiator 220 that is formed of a main radiator element 222 and a parasitic radiator element 224. Similarly, the antenna feed 204 includes a bent feeding probe 212B as well as the radiator 220. The feeding probes 212A and 212B are vertically below the main radiator element 222 and laterally staggered, and may be in the same one of the metal layers ML or respectively in two of the metal layers ML. The feeding probes 212A and 212B are respectively connected to vias 216A and 216B for electrically coupling other electrical components in the same antenna structure 200, such as an active electrical component (e.g. a switch), a passive electrical component (e.g. an inductor), a combination thereof, or an electrical device bonded to the antenna structure 200, such as an RFIC or a PCB. The antenna structure may include only one antenna feed which has only one bent feeding probe.

The antenna structure 200 also includes a grounding structure 230 for isolating the radiator 220. The grounding structure 230 may be a via wall structure including plural grounding vias 232. The grounding structure 230 has a rectangular frame shape in the planar view of the antenna structure 200, but the disclosure is not limited thereto.

The antenna structure 200 may include a similar arrangement of components and/or structures as the antenna structure 100, except that the antenna structure 200 does not have slots. In particular, in the antenna structure 200, the radiator 220 is fed by the probes 212A and 212B using a technique of electromagnetic coupling, and the vias 216A and 216B are covered by the radiator 220. The other elements of the antenna structure 200 may be respectively similar to those of the antenna structure 100, and thus will not be described again in detail.

Figure 3A:
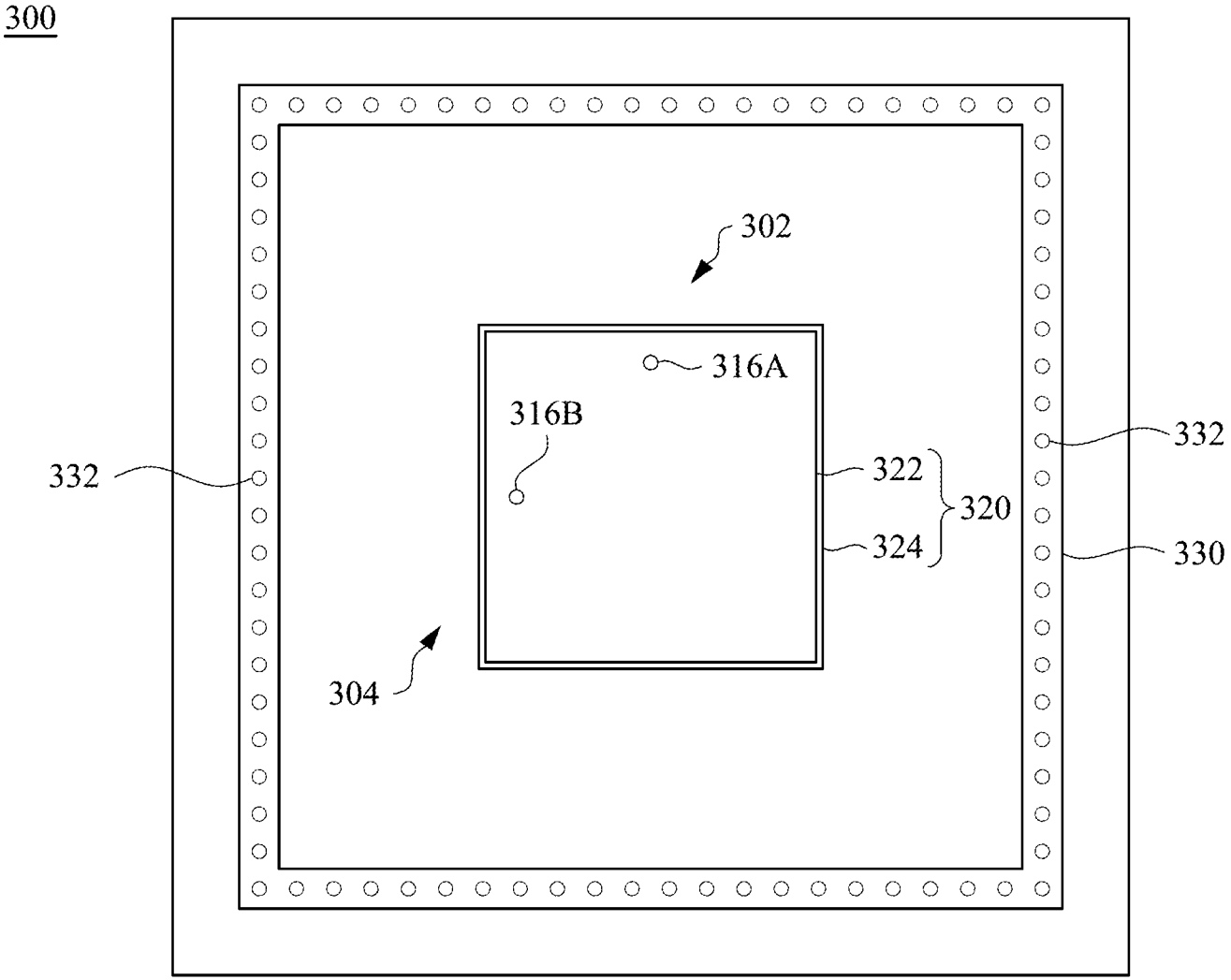
FIG. 3A is a top view of an antenna structure in accordance with some other implementations of the disclosure.
Figure 3B:
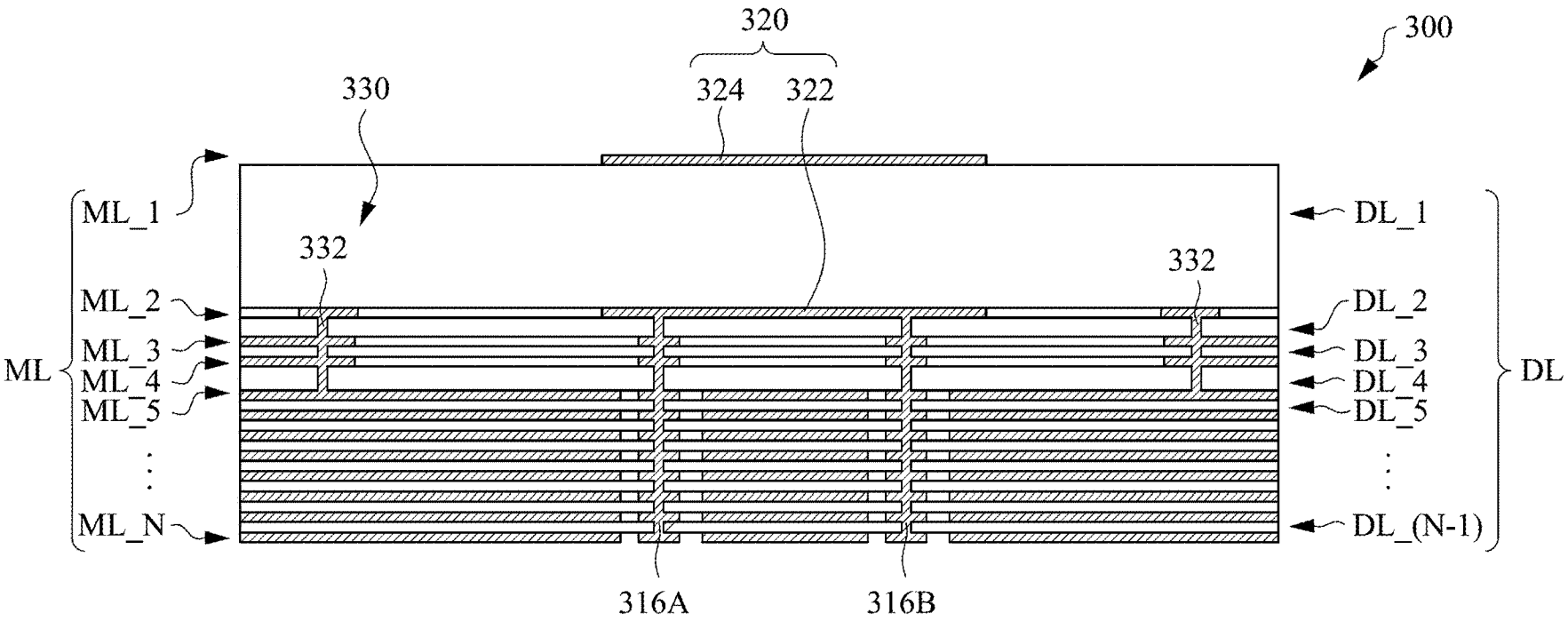
FIG. 3B is a partial schematic cross-sectional view of the antenna structure shown in FIG. 3A.

FIG. 3A is a top view of an antenna structure 300 in accordance with some other implementations of the disclosure, and FIG. 3B is a partial schematic cross-sectional view of the antenna structure 300 shown in FIG. 3A. The antenna structure 300 is a monolithic board structure with a stack of metal layers ML and dielectric layers DL. In the antenna structure 300, the metal layers ML are also respectively labeled as ML_1-ML_N from upper to lower, where N is the number of metal layers, and the dielectric layers DL are also respectively labeled as DL_1-DL_(N−1) from upper to lower. The antenna structure 300 includes two antenna feeds 302 and 304 which may also be referred to as a dual-polarized antenna feed, and the polarized directions of the antenna feeds 302 and 304 may be perpendicular.

The antenna feeds 302 and 304 include a radiator 320 that is formed of a main radiator element 322 and a parasitic radiator element 324. In addition, the antenna feeds 302 and 304 are coupled to difference feeding sources respectively through vias 316A and 316B which directly contact the main radiator element 322. The vias 316A and 316B may electrically couple to other electrical components in the same antenna structure 300, such as an active electrical component (e.g. a switch), a passive electrical component (e.g. an inductor), a combination thereof, or an electrical device bonded to the antenna structure 300, such as an RFIC or a PCB.

The antenna structure 300 also includes a grounding structure 330 for isolating the radiator 320. The grounding structure 330 may be a via wall structure including plural grounding vias 332. Similar to the grounding structure 230 of the antenna structure 200, the grounding structure 330 has a rectangular frame shape in the planar view of the antenna structure 300, but the disclosure is not limited thereto.

The antenna structure 300 may include a similar arrangement of components and/or structures as the antenna structure 200, except that the antenna structure 300 utilizes a technique of directly feeding. In particular, in the antenna structure 300, the radiator 320 is directly fed by the vias 316A and 316B. The other elements of the antenna structure 300 may be similar to those of the antenna structure 200, and thus will not be described again in detail.

Figure 4A:
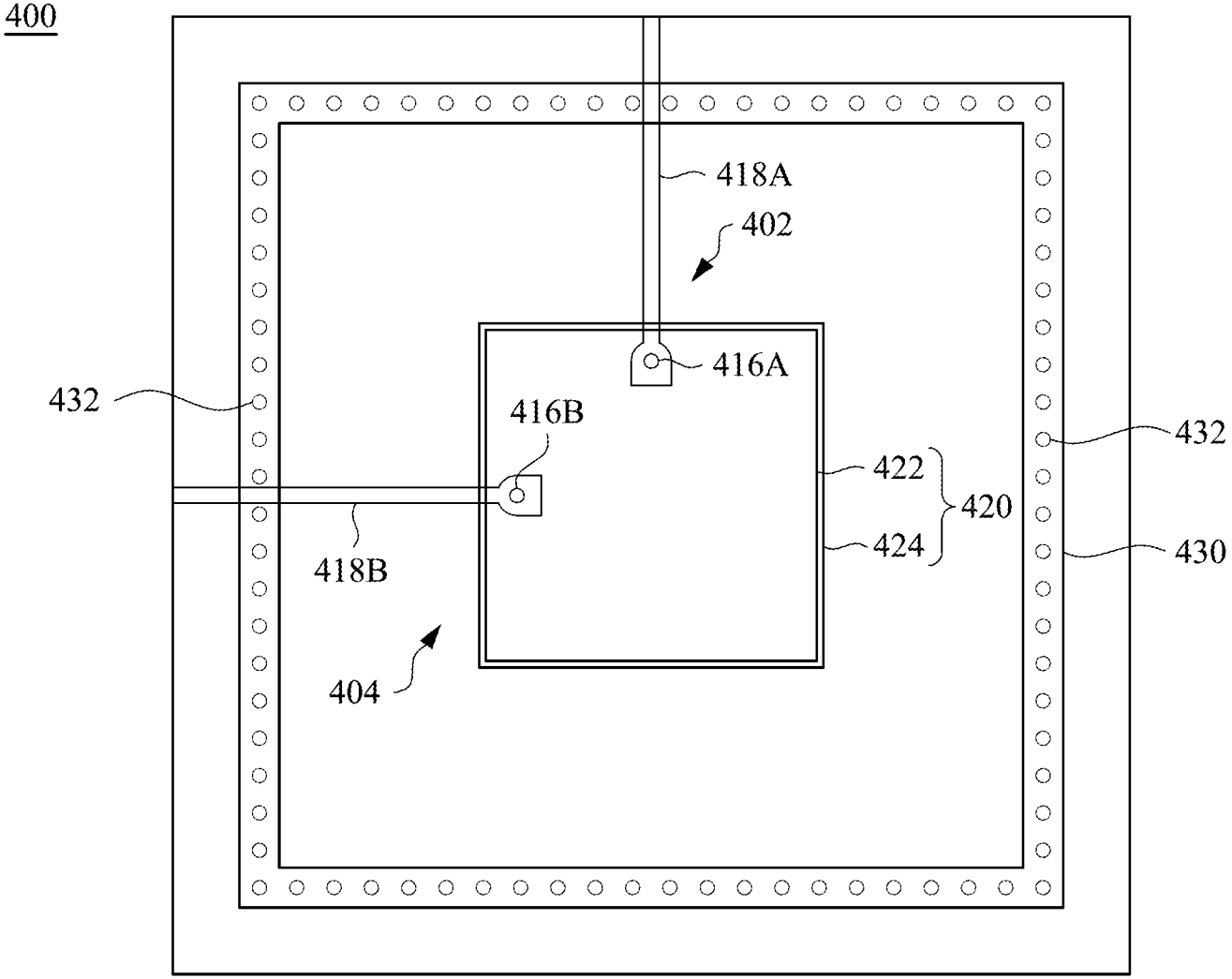
FIG. 4A is a top view of an antenna structure in accordance with some other implementations of the disclosure.
Figure 4B:
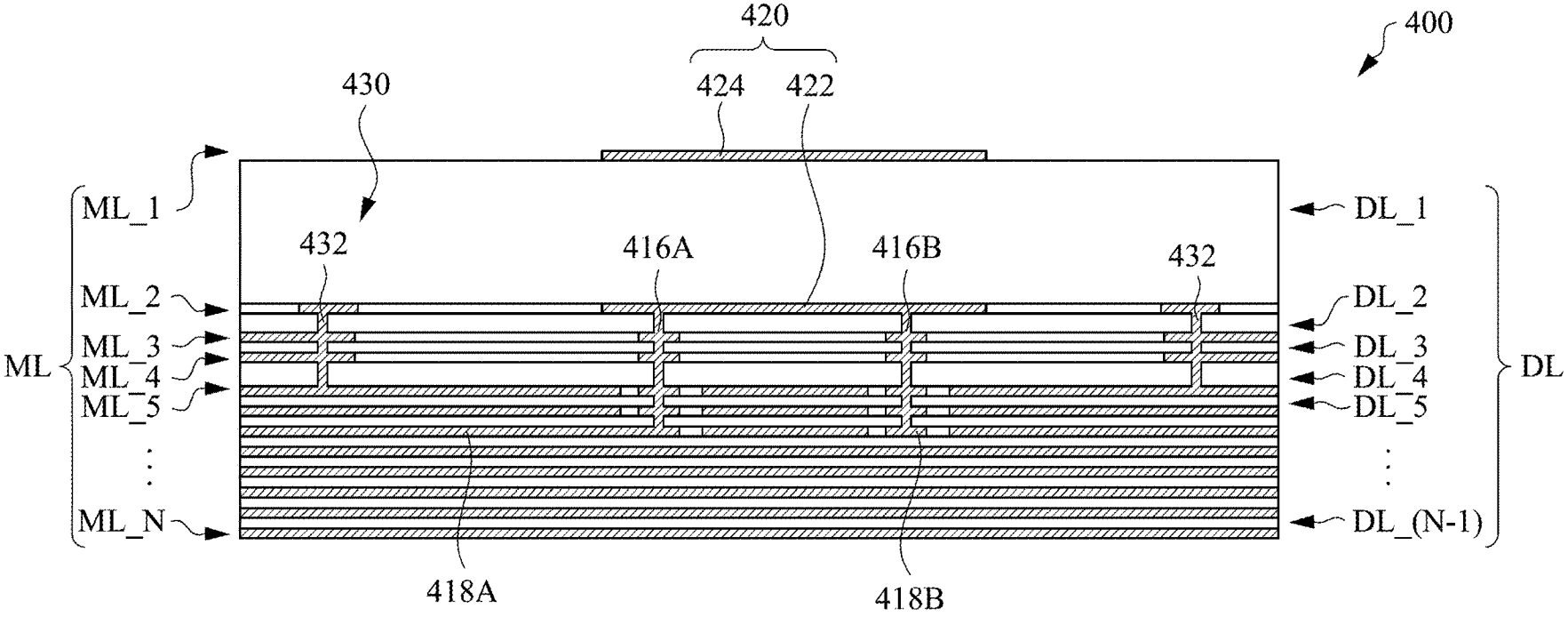
FIG. 4B is a partial schematic cross-sectional view of the antenna structure shown in FIG. 4A.

FIG. 4A is a top view of an antenna structure 400 in accordance with some other implementations of the disclosure, and FIG. 4B is a partial schematic cross-sectional view of the antenna structure 400 shown in FIG. 4A. The antenna structure 400 is a monolithic board structure with a stack of metal layers ML and dielectric layers DL. In the antenna structure 400, the metal layers ML are also respectively labeled as ML_1-ML_N from upper to lower, where N is the number of metal layers, and the dielectric layers DL are also respectively labeled as DL_1-DL_(N−1) from upper to lower. The antenna structure 400 includes two antenna feeds 402 and 404 which may also be referred to as a dual-polarized antenna feed, and the polarized directions of the antenna feeds 402 and 404 may be perpendicular.

The antenna feeds 402 and 404 include a radiator 420 that is formed of a main radiator element 422 and a parasitic radiator element 424. In addition, the antenna feeds 402 and 404 are coupled to difference feeding sources respectively through vias 416A and 416B. The vias 416A and 416B directly contacts traces 418A and 418B for electrically coupling other electrical components in the same antenna structure 400, such as an active electrical component (e.g. a switch), a passive electrical component (e.g. an inductor), a combination thereof, or an electrical device bonded to the antenna structure 400, such as an RFIC or a PCB. The traces 418A and 418B may be in the same one of the metal layers ML (e.g. the metal layer ML_7 shown in FIG. 4B) or respectively in two of the metal layers ML.

The antenna structure 400 also includes a grounding structure 430 for isolating the radiator 420. The grounding structure 430 may be a via wall structure including plural grounding vias 432. Similar to the grounding structure 330 of the antenna structure 300, the grounding structure 430 has a rectangular frame shape in the planar view of the antenna structure 400, but the disclosure is not limited thereto.

The antenna structure 400 may include a similar arrangement of components and/or structures as the antenna structure 300, except that the antenna structure 400 further includes the traces 418A and 418B that laterally extend through the grounding structure 430. The other elements of the antenna structure 400 may be similar to those of the antenna structure 300, and thus will not be described again in detail.

Figure 5:
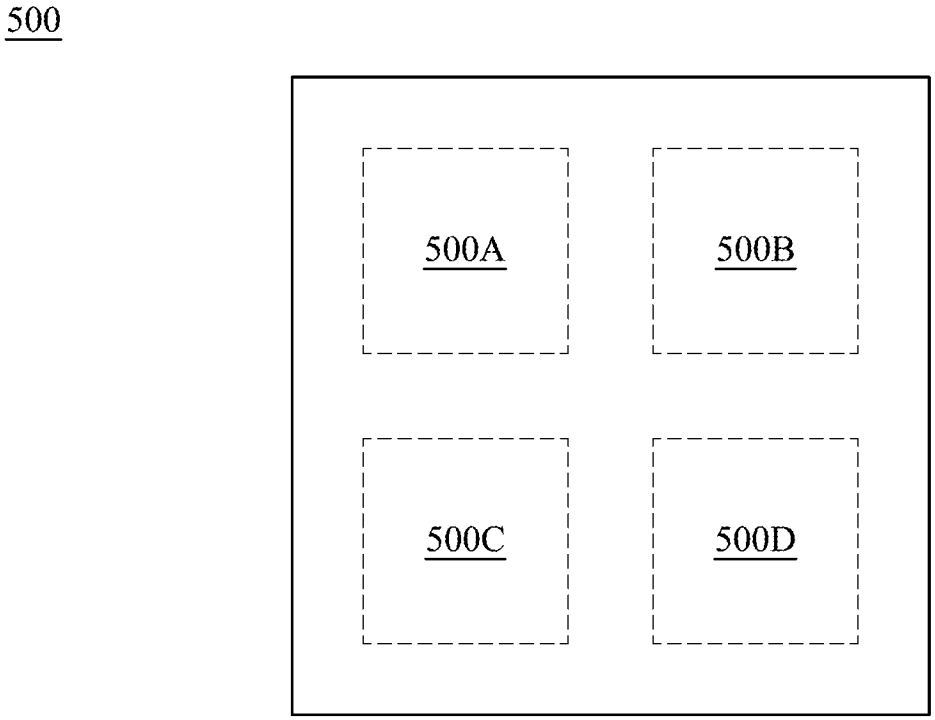
FIG. 5 is a schematic diagram of an antenna array in accordance with some implementations of the disclosure.

FIG. 5 is a schematic diagram of an antenna array 500 in accordance with some implementations of the disclosure. The antenna array 500 may be a phased antenna array or a combination of individual antenna modules, and may be packaged with an RFIC, a PCB and/or another electrical element to form an radio frequency (RF) module, and may be used as a multiple-input multiple-output (MIMO) antenna for various applications, such as 5G NR (New Radio), WiFi, etc.

In some examples, as shown in FIG. 5, the antenna array 500 has four antenna cells 500A-500D arranged in an array of two rows and two columns. Each of the antenna cells 500A-500D may have a structure similar to the antenna structure 100 shown in FIGS. 1A-1B, the antenna structure 200 shown in FIGS. 2A-2B, the antenna structure 300 shown in FIGS. 3A-3B or the antenna structure 400 shown in FIGS. 4A-4B. The antenna array 500 may be a stacked structure of plural metal layers and plural dielectric layers. In particular, in some implementations, the metal layers are alternately stacked with the dielectric layers in the normal direction of the antenna array 500. In such stacked structure, the antenna cells 500A-500D may be concurrently formed, and the stacked metal layers and dielectric layers extend crossing the antenna cells 500A-500D. That is, the dielectric layers and the metal layers of the antenna cells 500A-500D may be mapped in a one-to-one manner. In other words, the first meatal layer of the antenna cell 500A may be mapped to the first meatal layer of the antenna cell 500B, the first dielectric layer of the antenna cell 500A may be mapped to the first dielectric layer of the antenna cell 500B, the second meatal layer of the antenna cell 500A may be mapped to the second meatal layer of the antenna cell 500B, and the like. Another shape, arrangement and/or number of antenna cells may be made for various applications. For example, the antenna array 500 may be modified to have more than two rows of antenna cells and/or more than two columns of antenna cells, and/or each of the antenna cells 500A-500D may be in a rectangular or triangle shape or any other suitable shape. In some other examples, the antenna cells 500A-500D may be individual antenna modules. In particular, the antenna cells 500A-500D may be physically separated and each has a structure similar to the antenna structure 100 shown in FIGS. 1A-1B, the antenna structure 200 shown in FIGS. 2A-2B, the antenna structure 300 shown in FIGS. 3A-3B or the antenna structure 400 shown in FIGS. 4A-4B.

Figure 6:
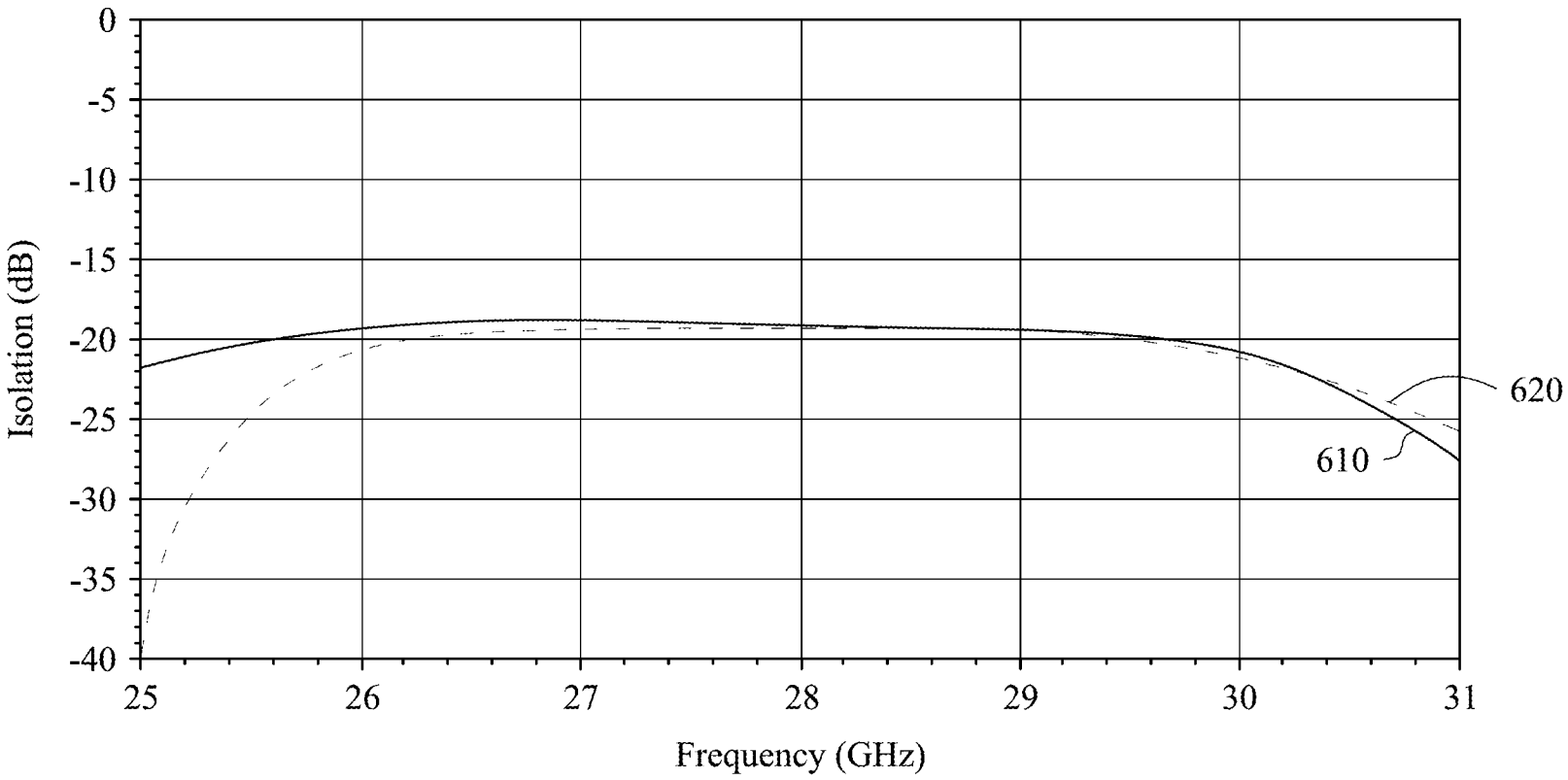
FIG. 6 is a graphical comparison of the measured isolation of an antenna array according to one implementation of the disclosure verses a comparative example of an array of antenna elements each with a conventional surface integrated waveguide (SIW) full-cavity backed antenna structure.

FIG. 6 is a graphical comparison of the measured isolation of an antenna array according to one implementation of the disclosure (shown as the curve 610) verses a comparative example of an array of antenna feeds each with a conventional SIW full-cavity backed antenna structure (shown as the curve 620), in which the vertical plot represents the isolation between two adjacent antenna feeds. As shown in FIG. 6, in the frequency range from 26.5 GHz to 29.5 GHz (same as 3GPP band n257), the isolation of the antenna array 500 according to the implementations of the disclosure differs from that of the comparative example by less than 1 dB. In more particular, the isolation of the antenna array 500 according to the implementations of the disclosure is almost identical to that of the comparative example in the frequency range from about 28 GHz to about 29 GHz.

Figure 7:
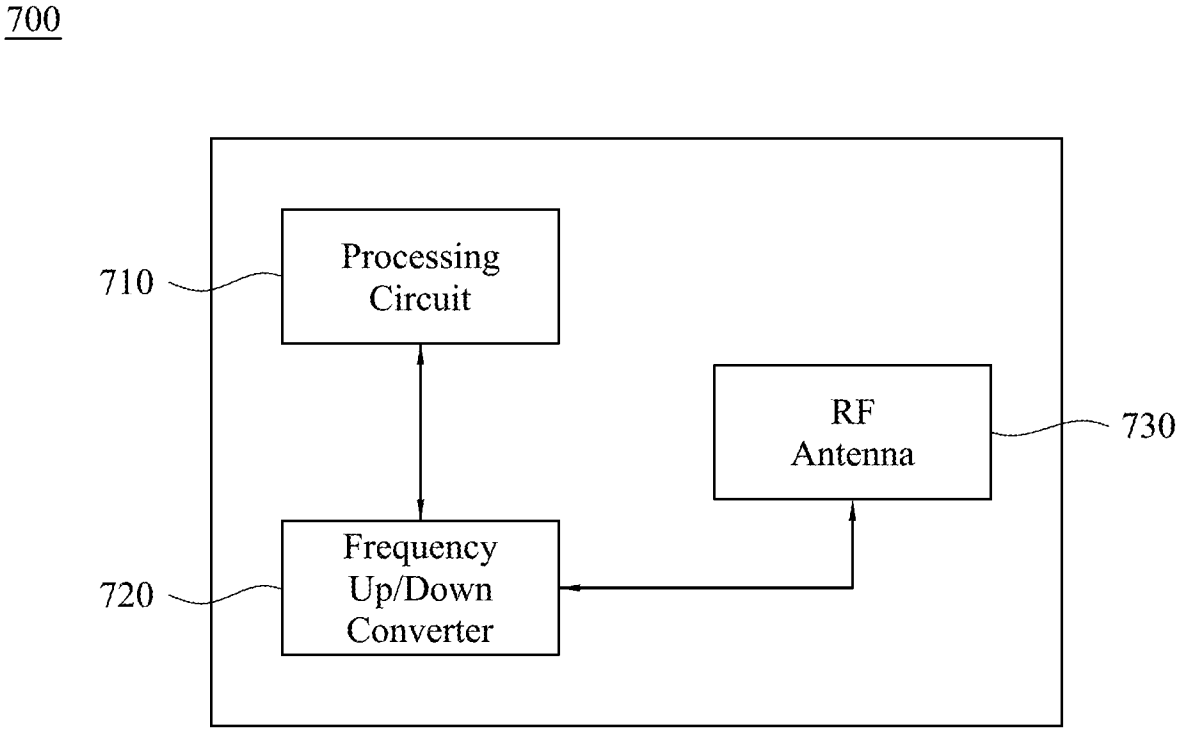
FIG. 7 is a schematic block diagram of a communication module in accordance with some implementations of the disclosure.

FIG. 7 is a schematic block diagram of a communication module 700 in accordance with some implementation of the disclosure. The communication module 700 includes a processing circuit 710, a frequency up/down converter 720 and an RF antenna 730. The processing circuit 710 may be configured to encode data bits to generate a coded baseband signal and decode the baseband signal from the frequency up/down converter 720 into data bits according to a protocol stack, such as Radio Resource Control (RRC), Media Access Control (MAC), Radio Link Control (RLC), Service Data Adaptation Protocol (SDAP), Packet Data Convergence Protocol (PDCP), physical layer (PHY) coding and decoding and/or the like. The processing circuit 710 may be a processor, a microprocessor, an application-specific integrated circuit (ASIC), a digital signal processor (DSP), a field programmable gate array (FPGA), and/or the like. The frequency up/down converter 720 may be configured to modulate the baseband signal outputted by the processing circuit 710 into an RF signal for radio transmissions through the RF antenna 730. In addition, the frequency up/down converter 720 may also be configured to demodulate the RF signal received through the RF antenna 730 to a baseband signal. The RF antenna 730 is configured to perform RF signal transmissions and receptions through air. The RF antenna 730 may include a singular antenna with an antenna structure according to the implementations of the disclosure (such as the antenna structure 100 shown in FIGS. 1A-1B, the antenna structure 200 shown in FIGS. 2A-2B, the antenna structure 300 shown in FIGS. 3A-3B or the antenna structure 400 shown in FIGS. 4A-4B), plural antennas at least one with an antenna structure according to the implementations of the disclosure (such as the antenna structure 100 shown in FIGS. 1A-1B, the antenna structure 200 shown in FIGS. 2A-2B, the antenna structure 300 shown in FIGS. 3A-3B and/or the antenna structure 400 shown in FIGS. 4A-4B), an array of antenna cells with an antenna structure according to the implementations of the disclosure (such as the antenna array 500 shown in FIG. 5. Another antenna structure or antenna array may also or alternatively be arranged in the RF antenna 730 of the communication module 700.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims.

What is claimed is:

1. An antenna structure having a stack of a plurality of dielectric layers and a plurality of metal layers, the antenna structure comprising:

a radiator having a parasitic radiator element, a main radiator element and a ground plane element respectively in a first metal layer, a second metal layer and a third metal layer of the plurality of metal layers, the parasitic radiator element and the main radiator element physically spaced by at least one first dielectric layer of the plurality of dielectric layers, the main radiator element and the ground plane element physically spaced by at least one second dielectric layer of the plurality of dielectric layers; and a grounding structure laterally surrounding between the main radiator element and the ground plane element for blocking electromagnetic radiation, but not between the parasitic radiator element and the main radiator element.

2. The antenna structure of claim 1, wherein the grounding structure comprises a plurality of grounding vias each vertically extending from the second metal layer to the third metal layer.

3. The antenna structure of claim 2, wherein the plurality of grounding vias are buried vias, blind vias, or a combination thereof.

4. The antenna structure of claim 1, wherein the grounding structure has a frame shape in a planar view of the antenna structure.

5. The antenna structure of claim 1, wherein the parasitic radiator element and the main radiator element are patches arranged in parallel in a normal direction of the antenna structure.

6. The antenna structure of claim 1, wherein the plurality of metal layers are alternately stacked with the plurality of dielectric layers.

7. The antenna structure of claim 1, further comprising:

a first slot and a second slot defined by the third metal layer;

a first feeding trace laterally overlapped with the first slot and configured to electromagnetically couple energy to the main radiator element through the first slot; and a second feeding trace laterally overlapped with the first slot and configured to electromagnetically couple energy to the main radiator element through the second slot.

8. The antenna structure of claim 7, wherein longitudinal directions of the first slot and the second slot are perpendicular.

9. The antenna structure of claim 7, wherein the first feeding trace and the second feeding trace are in the same one of the plurality of metal layers.

10. The antenna structure of claim 1, further comprising:

a first probe and a second probe vertically below the main radiator element and configured to electromagnetically couple energy to the main radiator element to enable dual-polarized radiation of the radiator.

11. The antenna structure of claim 10, wherein the first probe and the second probe are vertically covered by the main radiator element in a normal direction of the antenna structure.

12. The antenna structure of claim 1, further comprising:

a first via and a second via directly contacting the main radiator element and configured to feed energy to the main radiator element enable dual-polarized radiation of the radiator.

13. The antenna structure of claim 12, wherein the first via and the second via are covered by the main radiator element.

14. The antenna structure of claim 12, wherein the first via and the second via are blind vias.

15. The antenna structure of claim 12, further comprising:

a first trace and a second trace laterally extend through the grounding structure and respectively connected to the first via and the second via.

16. The antenna structure of claim 15, wherein the first via and the second via are buried vias.

17. The antenna structure of claim 15, wherein the first trace and the second trace are in the same one of the plurality of metal layers.

18. An antenna array comprising:

a plurality of antenna cells arranged in an array, each of the plurality of antenna cells having a stack of a plurality of dielectric layers and a plurality of metal layers, and each of the plurality of antenna cells comprising:

a radiator having a parasitic radiator element, a main radiator element and a ground plane element respectively in a first metal layer, a second metal layer and a third metal layer of the plurality of metal layers, the parasitic element radiator and the main radiator element physically spaced by at least one first dielectric layer of the plurality of dielectric layers, the main radiator element and the ground plane element physically spaced by at least one second dielectric layer of the plurality of dielectric layers; and a grounding structure laterally surrounding between the main radiator element and the ground plane element for blocking electromagnetic radiation, but not between the parasitic radiator element and the main radiator element.

19. The antenna array of claim 18, wherein the plurality of dielectric layers and the plurality of metal layers of the plurality of antenna cells are mapped in a one-to-one manner.

20. The antenna array of claim 19, wherein the plurality of antenna cells are physically separated.

* * * * *